US007311501B2

(12) United States Patent
Wehrenberg et al.

(10) Patent No.: US 7,311,501 B2
(45) Date of Patent: Dec. 25, 2007

(54) SCROLL COMPRESSOR WITH BIFURCATED FLOW PATTERN

(75) Inventors: Chris A. Wehrenberg, La Crosse, WI (US); Brian T. Sullivan, La Crosse, WI (US); Scott J. Smerud, La Crosse, WI (US)

(73) Assignee: American Standard International Inc., New York, NY (US)

( * ) Notice: Subject to any disclaimer, the term of this patent is extended or adjusted under 35 U.S.C. 154(b) by 359 days.

(21) Appl. No.: 10/376,568

(22) Filed: Feb. 27, 2003

(65) Prior Publication Data

US 2004/0170509 A1 Sep. 2, 2004

(51) Int. Cl.
*F04B 39/06* (2006.01)
*F04B 35/04* (2006.01)
*F01C 1/063* (2006.01)

(52) U.S. Cl. ..... 417/371; 417/410.5; 418/55.1; 418/55.6

(58) Field of Classification Search ..... 417/410.5, 417/371; 418/55.1, 55.6
See application file for complete search history.

(56) References Cited

U.S. PATENT DOCUMENTS 5,007,809 A * 4/1991 Kimura et al. ..... 417/371
5,240,391 A * 8/1993 Ramshankar et al. .... 417/410.1
5,316,454 A * 5/1994 Fujitani et al. ..... 418/55.6
5,366,352 A * 11/1994 Deblois et al. ..... 417/292
5,518,373 A * 5/1996 Takagi et al. ..... 417/45
5,785,151 A * 7/1998 Fry et al. ..... 184/6.16
6,000,917 A * 12/1999 Smerud et al. ..... 417/368
6,042,346 A * 3/2000 Doi ..... 417/371
6,135,727 A * 10/2000 Dreiman et al. ..... 417/415
6,247,907 B1 * 6/2001 Williams et al. ..... 417/410.5
6,474,964 B2 * 11/2002 De Bernardi et al. ..... 418/55.6
6,887,050 B2 * 5/2005 Haller ..... 418/55.1
2001/0006603 A1 * 7/2001 Hong et al. ..... 418/55.1

* cited by examiner

*Primary Examiner*—Charles G Freay
(74) *Attorney, Agent, or Firm*—William J. Beres; William O'Driscoll

(57) ABSTRACT

A scroll compressor includes various features that promote a bifurcated flow pattern of gas through a compressor shell to reduce oil entrainment. After entering the shell, some gas travels upward, which reduces the volume of gas traveling downward toward an oil sump. To accomplish this, the compressor's motor can be surrounded by a sleeve having upper and lower apertures for directing the flow to the motor's upper and lower stator end turns. In some embodiments, a suction inlet is strategically positioned relative to two gas passageways that are between the stator and the compressor shell. The inlet's position is such that one passageway receives incoming gas and divides the flow in opposite directions: upward and downward. The other passageway only conveys the gas upward. In addition, a suction baffle, a diffuser, a streamlined counterweight and/or a suction line oil trap can also help promote gas/oil separation or minimize oil entrainment.

10 Claims, 7 Drawing Sheets

FIG. 11
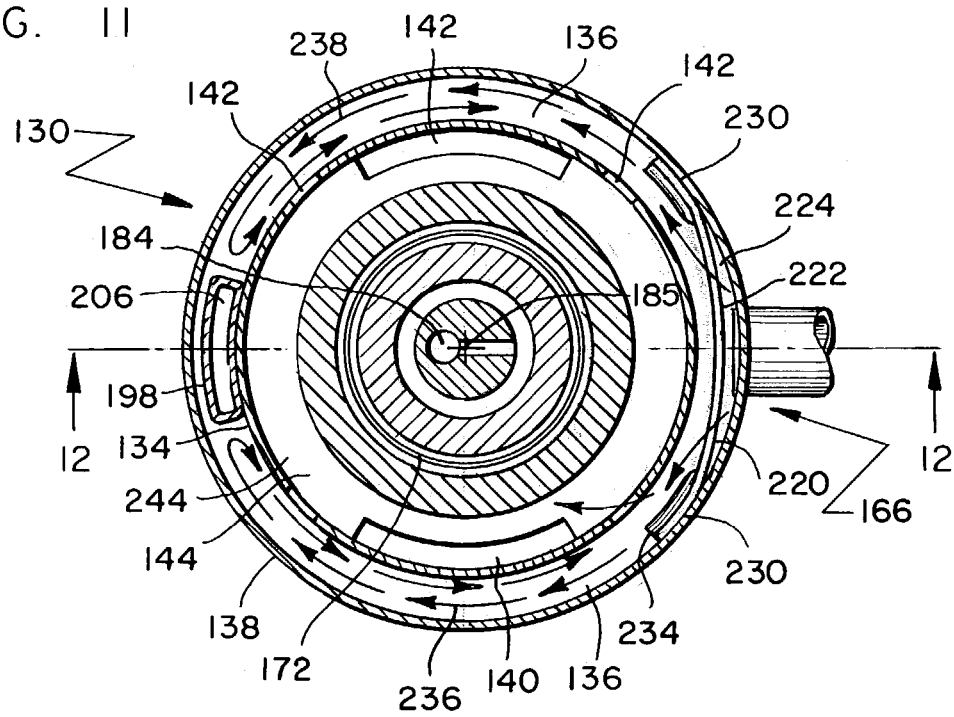
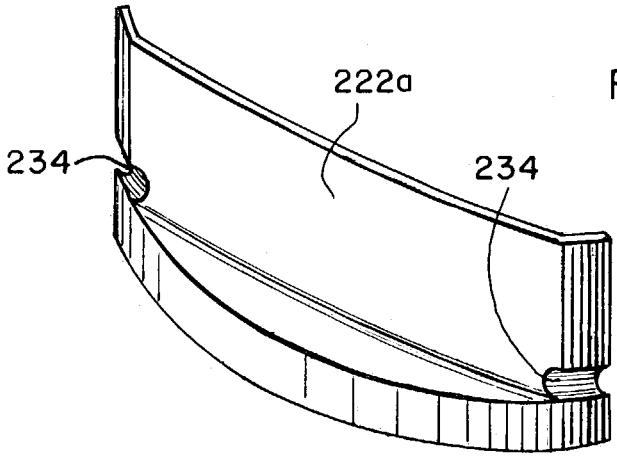
FIG. 15
FIG. 14
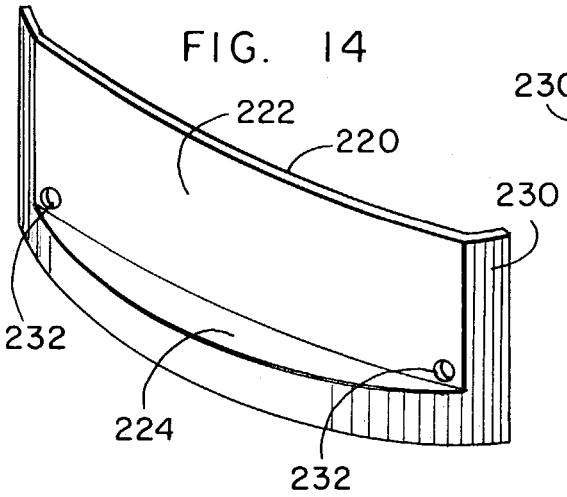
FIG. 16
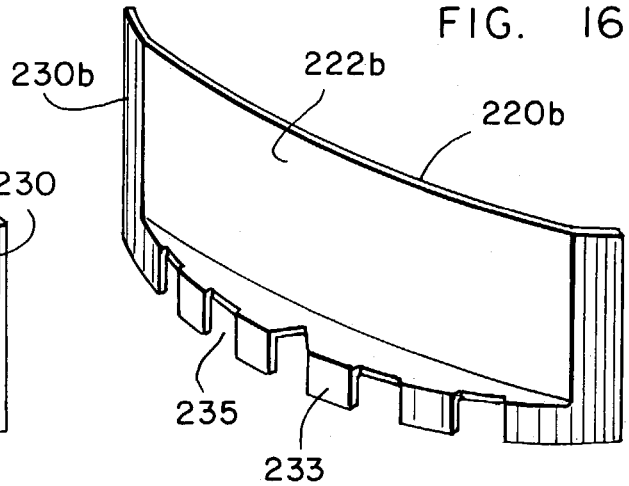

SCROLL COMPRESSOR WITH BIFURCATED FLOW PATTERN

BACKGROUND OF THE INVENTION

1. Field of the Invention

The present invention relates to scroll compressors and more specifically to structure that helps direct and separate the flow of gas and lubricant through the compressor.

2. Description of Related Art

Scroll compressors typically comprise two facing scroll members that are contained within a compressor shell. Scroll wraps on each scroll member interleave each other to create a series of compression chambers between the wraps. Proper relative movement between the scroll members cyclically recreates compression chambers along the outer perimeter of the scroll members, where suction gas enters, and subsequently forces the chambers to spiral inward. As the chambers approach the center of the scroll members, the volume of each chamber decreases, which compresses the gas trapped within the chambers. Upon reaching the center of the scroll members, the compressed gas is discharged from the compressor shell for use.

To minimize wear, scroll compressors usually have an oil pump that draws oil from an oil sump at the bottom of the compressor shell and forces the oil to various bearings and other moving parts of the compressor. Afterwards, the oil drains back to the oil sump for reuse. The pump is usually incorporated into a rotor shaft of a motor whose primary function is to drive the movement of one or both of the scroll members.

Since the gas and oil are in open fluid communication with each other, the gas may entrain some of the oil. Then, as the compressor discharges the compressed gas, the entrained oil is discharged as well, thus reducing the level of oil in the sump. The oil may eventually return to the compressor through a suction inlet of the compressor shell; however, if the discharged gas entrains an excessive amount of oil, the compressor may be left with an insufficient amount of oil in the sump.

Various conditions can cause the gas to entrain an excessive amount of oil. More oil is entrained, for instance, when gas moves at high velocity across the surface of the oil in the sump. Also, a protruding counterweight or other irregularity at the lower end of the rotor may create a gas vortex or turbulence that can agitate the oil in the sump. High velocity gas tends to entrain oil more readily from oil surfaces that are more agitated. In some cases, the oil returning to the sump may be opposed by a strong current of gas moving in an opposite direction away from the sump. The counter flow pattern of oil and gas tends to entrain more oil. Thus, it may be beneficial to separate the gas and oil flow paths as much as possible.

Keeping the gas flow completely away from the oil sump may reduce oil entrainment but may also create an overheating problem within the motor. Since the motor's rotor shaft usually serves as the pump and as a conduit for conveying the oil from the sump to the parts needing lubrication, the motor is preferably adjacent to the sump. This usually places the oil sump and the lower end turns of the motor's stator in proximity. Directing the gas away from the sump and thus away from the lower end turns of the motor may prevent the gas from being able to cool the lower end turns. As a result, the motor may overheat.

Consequently, there is a need for a scroll compressor that provides effective gas/oil separation without sacrificing motor cooling.

SUMMARY OF THE INVENTION

It is an object of some embodiments of the present invention is to provide a scroll compressor that provides effective gas/oil separation and sufficient motor cooling.

It is an object of some embodiments to reduce the gas flow near an oil sump of a scroll compressor.

It is an object of some embodiments to reduce the gas flow near an oil sump of a scroll compressor by diverting some of the incoming gas in an upward direction away from the oil sump.

It is an object of some embodiments to provide a scroll compressor with a motor sleeve that includes apertures at strategic locations for creating a desirable gas flow pattern.

It is an object of some embodiments to block off the lower end of a motor sleeve to help shelter the oil sump from high velocity gas flow.

It is an object of some embodiments to reduce the extent to which return oil is exposed to upwardly moving gas by connecting an oil drain tube to a scroll compressor's bearing housing.

It is an object of some embodiments to provide a scroll compressor with a suction baffle adjacent to a suction inlet of the compressor's outer shell, wherein the baffle directs the incoming gas upward through a suction chamber that is between a motor sleeve and the outer shell.

It is an object of some embodiments to provide the suction baffle with oil drain holes that are spaced apart from each other to drain oil from opposite ends of the baffle.

It is an object of some embodiments to provide a motor sleeve with upper apertures that direct a portion of the gas toward the upper end turns of a stator to cool those end turns, and so there is less gas available to flow near the oil sump.

It is an object of some embodiments to provide a motor sleeve with apertures of various size and location to distribute the gas flow in proper proportions through and around the motor.

It is an object of some embodiments to discharge from a scroll compressor a mixture of gas and oil, wherein the mass flow rate of the oil is less than one percent of the total mass flow rate discharged from the compressor.

It is an object of some embodiments to provide a scroll compressor whose incoming gas is divided into two portions, wherein one portions flows upward and the other flows downward upon first entering the compressor shell.

It is an object of some embodiments to swirl the gas flow in a circular pattern across upper and lower apertures of a motor sleeve.

It is an object of some embodiments to provide a scroll compressor with a suction inlet and a motor sleeve with apertures, wherein the suction inlet is circumferentially offset relative to the apertures to promote a desired gas flow pattern.

It is an object of some embodiments to provide slots in a stator core for conveying gas, and circumferentially offsetting the location of the slots relative to apertures in a motor sleeve to promote a desired gas flow pattern.

It is an object of some embodiments to position apertures in a motor sleeve such that the apertures direct gas flow in areas between the stator's core and its end turns.

It is an object of some embodiments to combine the use of a motor sleeve and an oil drain tube to avoid excessive mixing of oil and gas.

It is an object of some embodiments to provide an oil return path that include a round hole in fluid communication with an oblong drain tube, wherein the round hole is relatively easy to produce, and the oblong drain tube more readily fits between a motor sleeve and a compressor shell than would a round tube of a diameter equal to or greater than the round hole.

It is an object of some embodiments to provide two gas flow passageways between a stator and a compressor shell, wherein gas flows upward through one passageway and splits into upward and downward flow directions through the other.

It is an object of some embodiments to provide a scroll compressor with a bearing housing that includes a cast-in, radially extended oil passageway that reduces the extent to which return oil is exposed to upwardly moving gas.

It is an object of some embodiments to cool the upper end turns of a stator with gas that has not been preheated by the lower end turns.

It is an object of some embodiments to position a suction inlet closer to the upper end turns than to the lower end turns.

It is an object of some embodiments to circumferentially offset the position of the suction inlet relative to a gas flow inlet of an upper bearing housing.

It is an object of some embodiments to apportion the gas across various paths within a compressor shell to minimize oil entrainment.

It is an object of some embodiments to promote oil/gas separation by a combined method of flow restriction and gas expansion.

It is an object of some embodiments to provide a streamlined counterweight to reduce turbulence near an oil sump.

It is an object of some embodiments to provide a compressor with a diffuser that has vertically and horizontally offset baffles that redirect the gas flow near the lower end of the compressor's motor.

One or more of the above-listed objects of the invention are provided by a scroll compressor wherein two gas passageways are defined between the stator and a compressor shell or between the stator and a motor sleeve. Gas is directed through the compressor shell in a bifurcated flow pattern that reduces the velocity of gas flowing adjacent to an oil sump at the bottom of the shell, which helps reduce the amount of oil entrainment.

BRIEF DESCRIPTION OF THE DRAWINGS

FIG. 11 is a cross-sectional view taken along line 11-11 of FIG. 9.

FIG. 14 is a perspective view of a suction baffle.

FIG. 15 is a perspective view of another suction baffle.

FIG. 16 is a perspective view of another suction baffle.

DESCRIPTION OF THE PREFERRED EMBODIMENT

Figure 1:
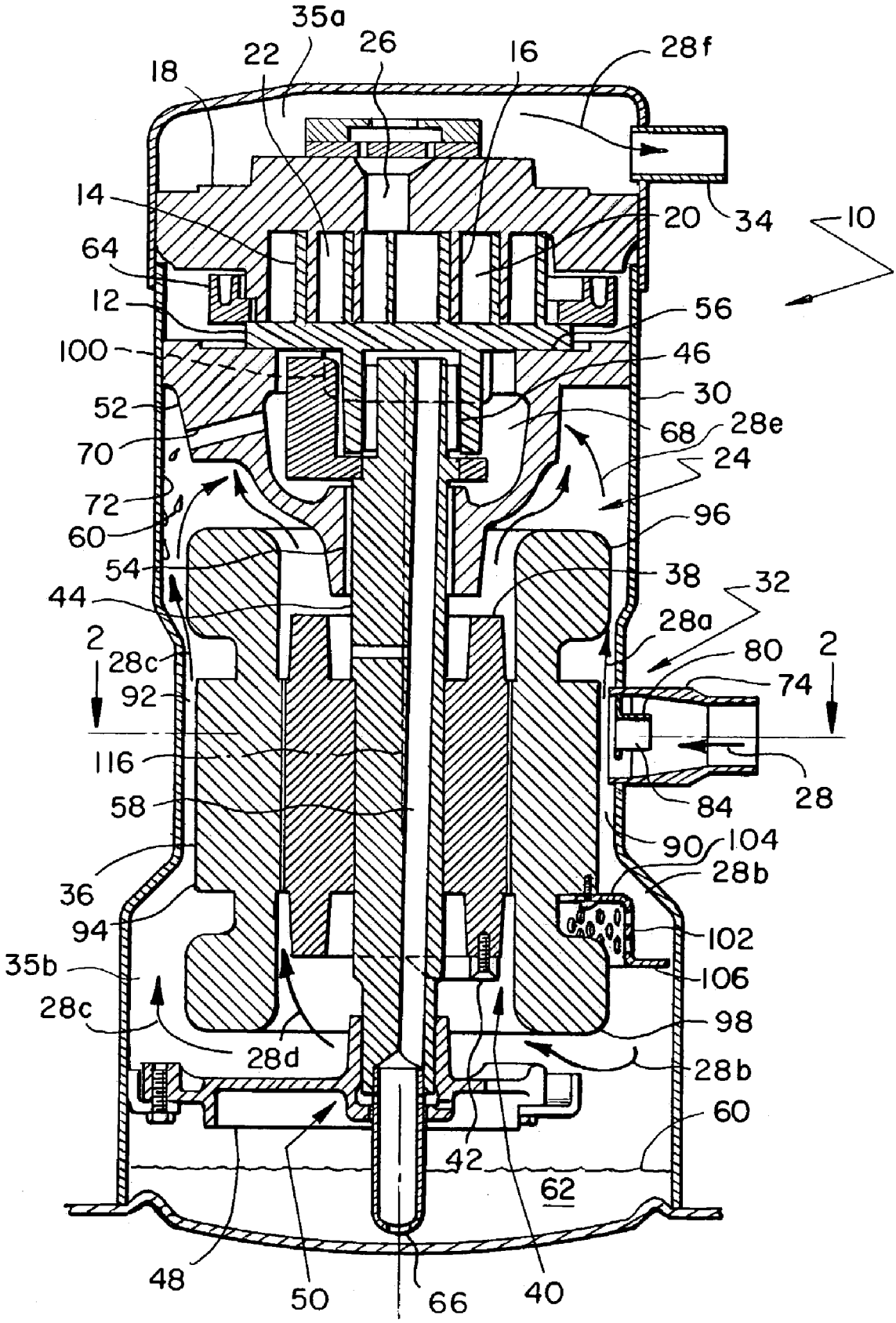
FIG. 1 is a cross-sectional view of a scroll compressor according to one embodiment of the invention.
Figure 2:
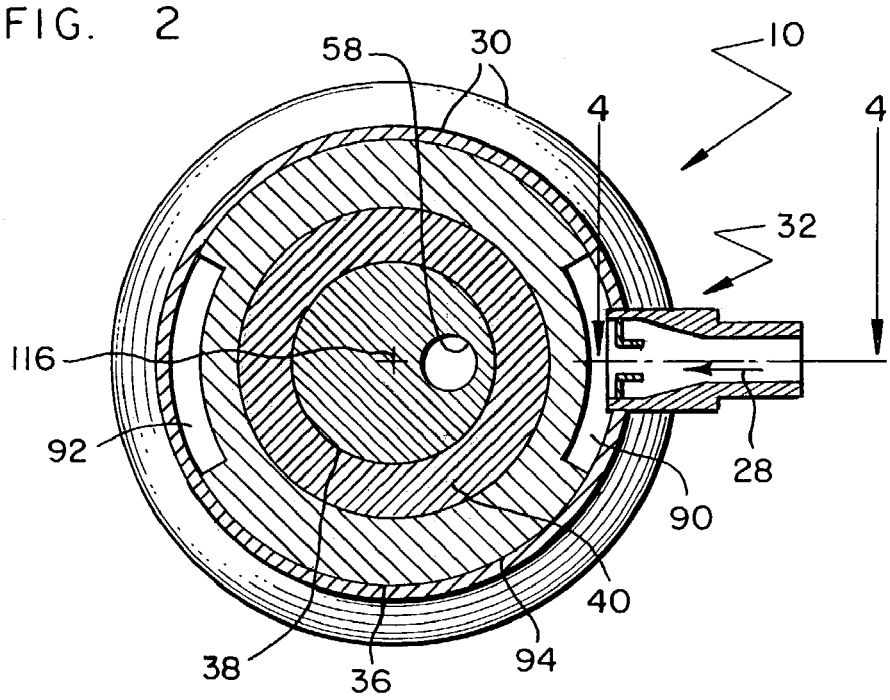
FIG. 2 is a cross-sectional view taken along line 2-2 of FIG. 1.

FIGS. 1 and 2 show cross-sectional view of a scroll compressor 10 having gas and oil flow patterns that minimize oil entrainment. It should be noted that the terms, "oil " and "lubricant" both refer to any fluid that helps reduce frictions.

Scroll compressor 10 comprises a driven scroll member 12 with a scroll wrap 14 that interleaves a similar scroll wrap 16 of another scroll member 18. The two scroll wraps define several compression chambers, such as chambers 20 and 22, for compressing a refrigerant or other type of gas, air for instance. A motor 24 drives scroll member 12 in an orbital motion relative to scroll member 18. The relative movement between the two scroll members forces the compression chambers to spiral toward a discharge opening 26 of scroll member 18. As the compression chambers approach discharge opening 26, the volumes of the compression chambers decrease, thereby compressing the gas trapped within the chambers. As will be described in more detail below, gas 28 enters compressor 10, flows to and enters the scroll wraps near the outer perimeters of scroll members 12 and 18, and exits compressor 10, at a higher pressure, through discharge opening 26. The main components of compressor 10 are contained within a compressor shell 30 having a suction inlet 32 for receiving gas at a relatively low pressure and an outlet 34 for discharging gas at a higher pressure. The upper interior portion 35*a* of shell 30 is referred to as the discharge pressure portion or high side of the compressor, while lower interior portion 35*b* is referred to as the low side or suction pressure portion of the compressor.

To drive scroll member 12, motor 24 includes a stator 36 for creating a magnetic field, a rotor 38 rotated by the magnetic field and defining a rotor gap 40 between the stator and the rotor, a counterweight 42 attached to a lower end of rotor 38 for dynamic balance, and a rotor shaft 44 extending through rotor 38 and coupled by an eccentric bearing 46 to drive scroll member 12 in an orbital motion. A lower bearing housing 48 includes a lower bearing system 50 for radially and axially supporting rotor 38 and shaft 44 on which rotor 38 is mounted. An upper bearing housing 52 includes an upper bearing 54 for radially supporting rotor 38 and shaft 44 on which rotor 38 is mounted. Upper bearing housing 52 also includes a thrust bearing surface 56 for vertically supporting orbital scroll member 12.

Rotor shaft 38 defines an inclined oil gallery 58 that conveys oil 60 (or another type of lubricant) up from an oil sump 62 at the bottom of shell 30 and delivers the oil to various moving parts of the compressor. Such moving parts include, but are not limited to, lower bearing system 50, upper bearing 54, eccentric bearing 46, thrust bearing surface 56, and an anti-rotation device 64 that maintains a proper angular relationship between scroll members 12 and 18. Centrifugal force created by inclined, radially offset oil gallery 58 and/or an impeller at the lower end of shaft 44 provides the impetus to move the oil upward through an oil inlet 66 that is submerged in oil sump 62.

After lubricating the compressor's moving parts, the oil may follow various paths back to sump 62. The oil leaving lower bearing system 50 drains into sump 62 by passing through open areas defined in lower bearing housing 48. A greater portion of oil 60, which is delivered through gallery 58, lubricates and then leaves upper bearing 54, thrust bearing surface 56 and eccentric bearing 46 and drains into an inner cavity 68 of upper bearing housing 52. An oil passageway 70 whose length to diameter ratio is at least three extends radially (either horizontally or slightly inclined as shown) through bearing housing 52. The extended length of passageway 70 enables the passageway to convey oil 60 from within cavity 68 and direct the oil near or onto an inner surface 72 of compressor shell 30. Oil passageway 70 is an integral feature of bearing housing 52. After leaving passageway 70, the oil drains along surface 72, through the open areas defined in lower bearing housing 48, and into sump 62.

The location of the oil return paths in relation to the gas flow pattern within compressor shell 30 can significantly affect how much oil the gas entrains. Preferably, the gas exiting the compressor contains less than one percent by mass of entrained oil. To achieve this, the gas 28 is directed through the compressor in a strategic manner.

Figure 3:
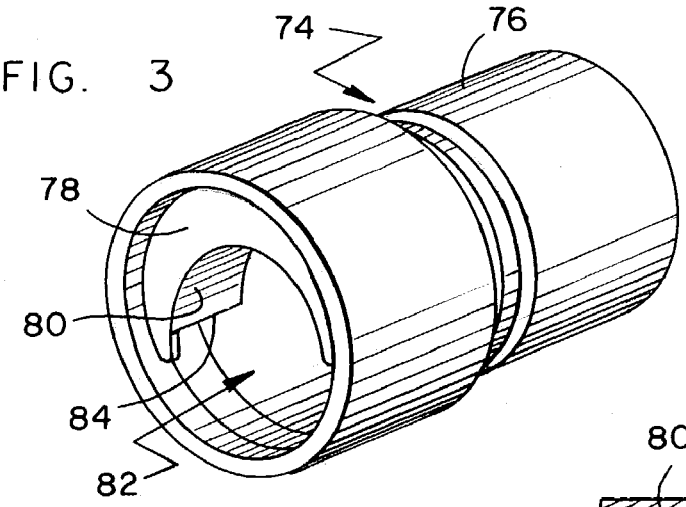
FIG. 3 is a perspective view of a suction line oil trap.
Figure 4:
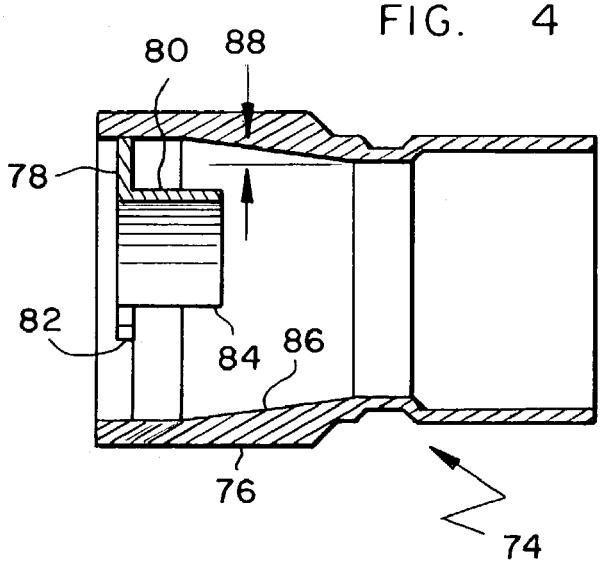
FIG. 4 is a cross-sectional view taken along line 4-4 of FIG. 2.
Figure 5:
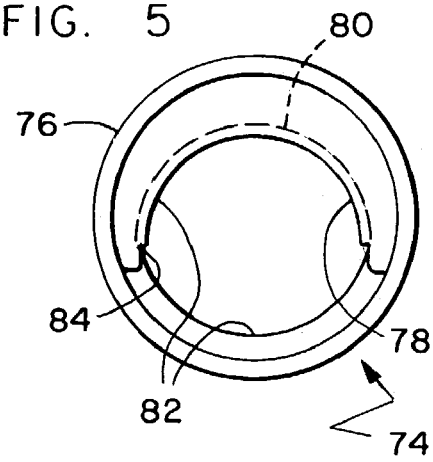
FIG. 5 is an end view looking upstream at the suction line oil trap of FIG. 3.

Gas 28 entering suction inlet 32, for instance, passes through an oil trap 74, which is shown in greater detail in FIGS. 3, 4, and 5. Oil trap 74 includes a suction tube 76 leading to suction inlet 32, an orifice plate 78 extending radially inward from suction tube 76 for restricting gas flow therethrough, and a flow divider 80 extending from orifice plate 78 in an upstream direction through tube 76. The orifice plate defines an opening 82 through which substantially all of the gas and oil within suction tube 76 eventually passes. Orifice plate 78 can be crescent-shaped and situated such that the location of opening 82 is offset toward a lower portion of suction tube 76. Flow divider 80 may assume various shapes. For example, in some embodiments, flow divider 80 has a semi-cylindrical shape with lower edges 84 that are spaced apart from suction tube 76.

To maintain or enhance gas/oil separation, suction tube 76 has an inner wall 86 that diverges but at an angle 88 of less than twenty degrees. If angle 88 is too large, oil droplets are less likely to cling to the tapered wall 86. To maintain gas/oil separation and surface-clinging ability, angle 88 is preferably at seven degrees. The flow restriction provided by orifice plate 78 further ensures oil/gas separation. With the combined effects of tapered wall 86 and orifice plate 78, oil tends to be separated from the gas flow and cling to wall 86 and is directed toward a lower portion of tube 76.

Above flow divider 80, orifice plate 78 inhibits oil from being flowing directly into shell 30. Instead, that oil flows downward along the curved upper surface of flow divider 80 until the oil descends below the divider's lower edges 84 and reaches opening 82 near the bottom of tube 76. Upon entering shell 30, a first portion of gas 28*a* travels upward while a second portion of gas 28*b* travels downward and carries the disentrained oil downward toward sump 62. By directing a first portion of gas 28*a* upward upon its entry into shell 30, the amount of gas that travels downward is reduced which, in turn, reduces the gas flow velocity near sump 62.

The vertically bifurcated gas flow pattern entering shell 30 is due to the suction inlet's position relative to the location of a first gas passageway 90 and a second gas passageway 92 that are defined between a stator core 94 and shell 30. Stator core 94 is a laminated ferrous portion of stator 36 that helps concentrate the magnetic field that is generated by electrical current passing through the windings of stator 36. Upper end turns 96 of the windings extend above core 36 and lower end turns 98 extend below core 36. In some embodiments, gas passageways 90 and 92 are slots that run vertically along stator core 94. Between the slots, the outer diameter of core 94 is in substantial abutment with the inner wall 72 of shell 30. By positioning suction inlet 32 vertically between upper end turns 96 and lower end turns 98, the incoming gas tends to divide into first and second portions 28*a* and 28*b*.

The first portion of gas 28*a* travels upward through gas passageway 90 to help cool upper end turns 96 before entering one or more inlets 100 in bearing housing 52. From inlets 100, the gas enters the scroll wraps to be compressed. Bearing housing 52 preferably has two inlets 100 that are circumferentially 180-degrees apart from each other and circumferentially 90-degrees offset to suction inlet 32. Such an arrangement promotes a gas flow pattern that "wraps" around upper end turns 96 for more evenly distributed cooling. Moreover, the first portion of gas 28*a* may be quite cool as that portion of the gas will not have been preheated by flow past the lower end turns 98.

Figure 6:
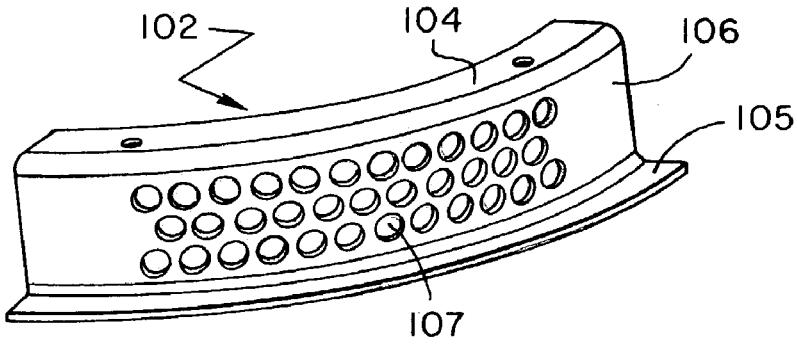
FIG. 6 is a perspective view of a diffuser.
Figure 6A:
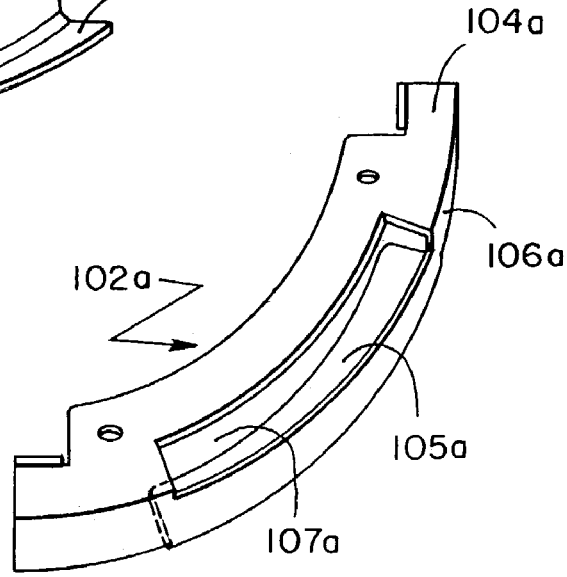
FIG. 6A is a perspective view of an alternative diffuser.

The second portion of gas 28b travels from suction inlet 32 downward through first gas passageway 90. To avoid the second portion of gas 28*b* from "blasting" directly downward against the surface of oil 60 in sump 62, a diffuser 102 is installed at a lower end of gas passageway 90. Referring to FIG. 6, diffuser 102 includes an upper baffle 104 and a lower baffle 105 that redirect the gas flow more horizontally. The two baffles 104 and 105 can be joined to each other by a surface 106 and attached to stator core 90, as shown, or the baffles may be separate parts with one attached to stator 94 and the other attached to shell 30. One or more apertures 107 provide a flow path for gas through the diffuser. The same description applies with respect to the alternate embodiment of FIG. 6A and its baffles 104*a* and 105*a*, surface 106*a* and aperture 107*a*.

The second portion of gas 28*b* passes underneath stator 36 to cool lower end turns 98. The second portion of gas 28*b* divides into a third portion of gas 28*c* that travels upward through second gas passageway 92 and a fourth portion of gas 28*d* that travels upward through rotor gap 40. Hence, the second portion of gas 28*b* flowing downward through the first gas passageway 90 flows at a mass flow rate that is substantially equal to the combined mass flow rate of gas passing through the second gas flow passageway 92 and rotor gap 40. The first gas passageway 90 conveys more gas than does the second gas passageway 92, and passageway 92 conveys more gas than does rotor gap 40. Near the upper portion of stator 36, the various portions of gas intermix, and-substantially all the intermixed gas 28*e* passes through inlets 100 of upper bearing housing 52 to enter the chambers between the scroll wraps. That gas is compressed, flows through discharge opening 26 and exits the compressor as discharge pressure gas 28*f* which flows through outlet 34.

Figure 7:
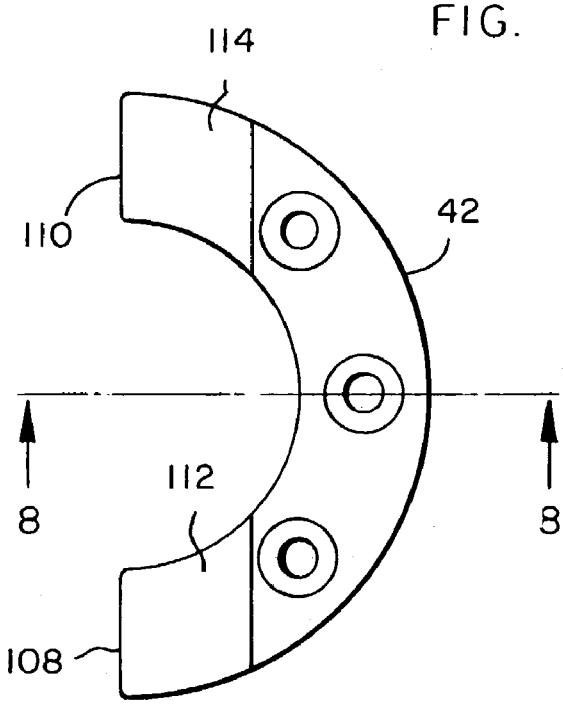
FIG. 7 is a bottom view of a streamlined counterweight.
Figure 8:
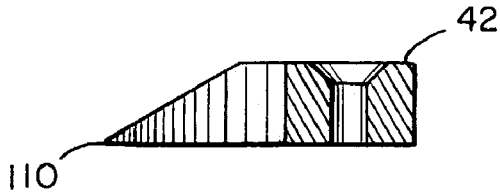
FIG. 8 is a cross-sectional view taken along line 8-8 of FIG. 7.

Since gas turbulence near the bottom of the compressor can agitate the surface of the oil in sump 62, counterweight 42 can be provided with a streamlined nose 108 and a streamlined tail 110 that minimizes the turbulence. In FIGS. 7 and 8, counterweight 42 is shown having a beveled leading edge 112 and a beveled trailing edge 114 that lie at an angle relative to a rotational axis 116 of rotor 44.

Figure 9:
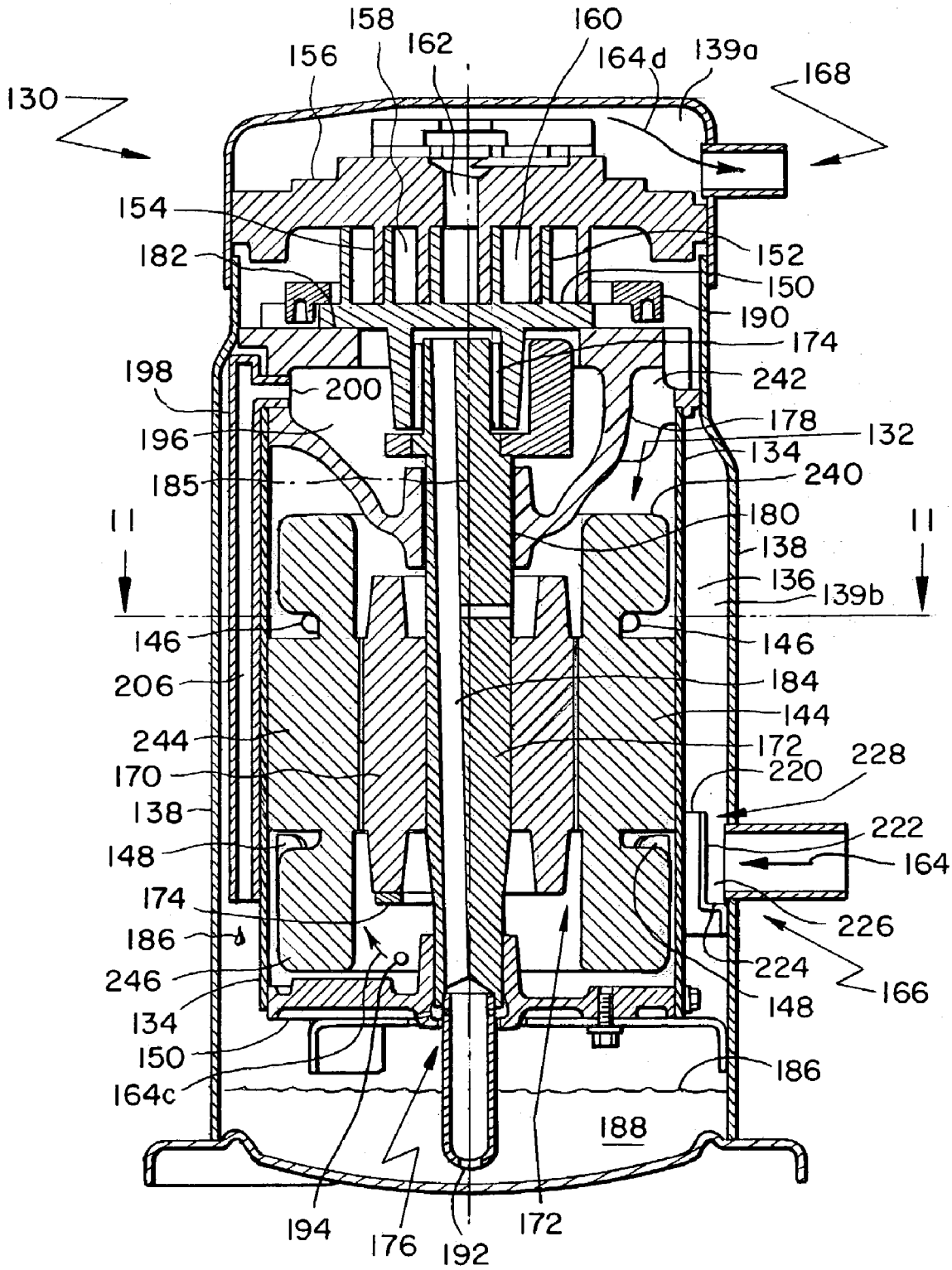
FIG. 9 is a cross-sectional view of a scroll compressor according to another embodiment of the invention.
Figure 10:
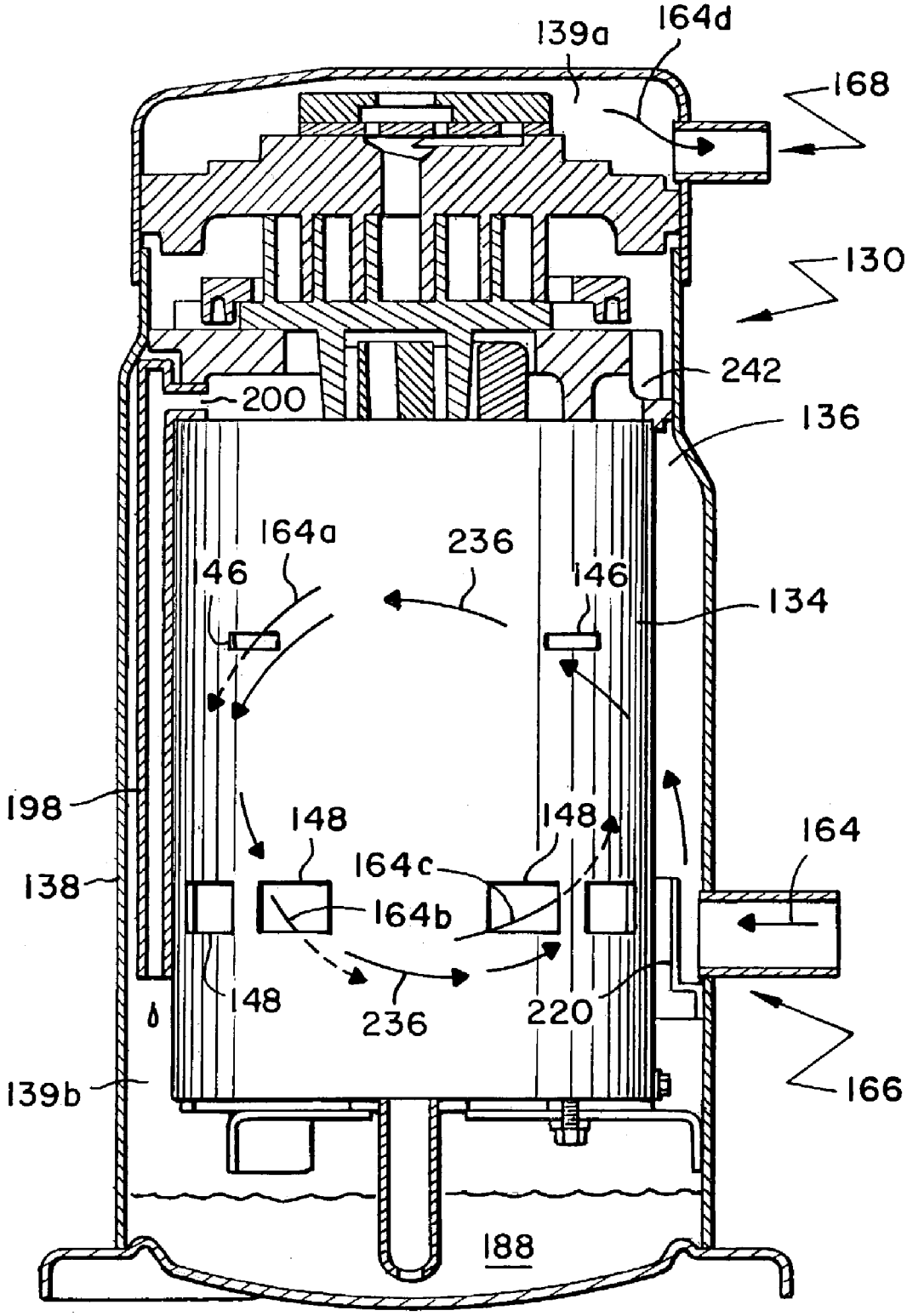
FIG. 10 is cross-sectional view similar to FIG. 12 but with the motor sleeve not being cross-sectioned.

In another embodiment, shown in FIGS. 9, 10 and 11, a scroll compressor 130 includes a motor 132 surrounded by a motor sleeve 134. A generally cylindrical suction chamber 136 is defined between sleeve 134 and compressor shell 138. Compressor 130 includes a discharge pressure portion or high side 139*a* within shell 138 as well as a suction pressure portion or low side 139*b* therein. Referring especially to FIG. 11, a first gas passageway 140 and a second gas passageway 142 are defined between the interior of sleeve 134 and the exterior of motor stator 144. To minimize the mixing of oil and gas, motor sleeve 134 defines upper apertures 146 and lower apertures 148 through which gas flows to the interior of sleeve 134 and the lower end of sleeve 134 is blocked off by a lower bearing housing 150. The interior of sleeve 134 is therefor shielded and/or isolated from the oil sump which lies beneath it, as will subsequently be described.

Similar to compressor 10 embodiment of FIGS. 1 and 2, compressor 130 includes a driven scroll member 150 with a scroll wrap 152 that interleaves a similar scroll wrap 154 of another scroll member 156. The two scroll wraps define several compression chambers, such as chambers 158 and 160, for compressing a refrigerant or other type of gas. Motor 132 drives scroll member 150 in an orbital motion relative to scroll member 156. The relative movement between the two scroll members forces the compression chambers to spiral toward a discharge opening 162 of scroll member 156. As the compression chambers approach discharge opening 162, the volumes of the compression chambers decrease, thereby compressing the gas trapped within the chambers. Gas 164 enters the compressor, flows to the scroll wraps near the outer perimeter thereof, is compressed and exits the compressor at a higher pressure through discharge opening 162. The main components of compressor 130 are contained within compressor shell 138 which has a suction inlet 166 for receiving gas 164 at a relatively low pressure and an outlet 168 for discharging the gas at a higher pressure.

To drive scroll member 150, motor 132 includes stator 144 for creating a magnetic field, a rotor 170 rotated by the magnetic field and defining a rotor gap 172 between the stator and the rotor, a counterweight 174 attached to a lower end of rotor 170 for dynamic balance, and a rotor shaft 172 centrally located on rotor 170 and coupled by an eccentric bearing 174 to drive scroll member 150 in an orbital motion. Lower bearing housing 150 includes a lower bearing system 176 for radially and axially supporting rotor 170 and shaft 172 on which the rotor is mounted. An upper bearing housing 178 includes an upper bearing 180 for radially supporting shaft 172 and rotor 170. Upper bearing housing 178 also includes a thrust bearing surface 182 for vertically supporting orbital scroll member 150.

Rotor shaft 172 defines an inclined oil gallery 184 that conveys oil 186 (or another type of lubricant) up from an oil sump 188 at the bottom of shell 138 and delivers the oil to various moving parts of the compressor. Such moving parts include, but are not limited to, lower bearing system 176, upper bearing 180, thrust bearing surface 182, and an anti-rotation device 190 that maintains a proper angular relationship between scroll members 150 and 156. Centrifugal force created by the rotation of shaft 172 and inclined, radially offset oil gallery 184 and/or an impeller at the lower end of shaft 172 provides the impetus to move the oil upward through an oil inlet 192 of shaft 172 that is submerged in the oil 186 in sump 188.

After lubricating the compressor's moving parts, the oil may follow various paths back to sump 188. A substantial portion of oil 186, which lubricates and then leaves upper bearing 180 and eccentric bearing 180, drains into an inner cavity 196 of upper bearing housing 178. A drain tube 198 connected to an oil passageway 200 of bearing housing 178 drains the oil from cavity 196 into oil sump 188. A much smaller portion of oil leaving lower bearing system 176 and thrust bearing surface 182 may coat various surfaces within the compressor or become entrained by the gas flow that occurs within shell 138. Discharged entrained oil may eventually return to the suction side of the compressor. When the compressor is de-energized, oil coating surfaces within motor sleeve 134 may also drain back into sump 188 from the interior of sleeve 134 via a drain hole 194 which is defined at the lower end thereof.

Figure 12:
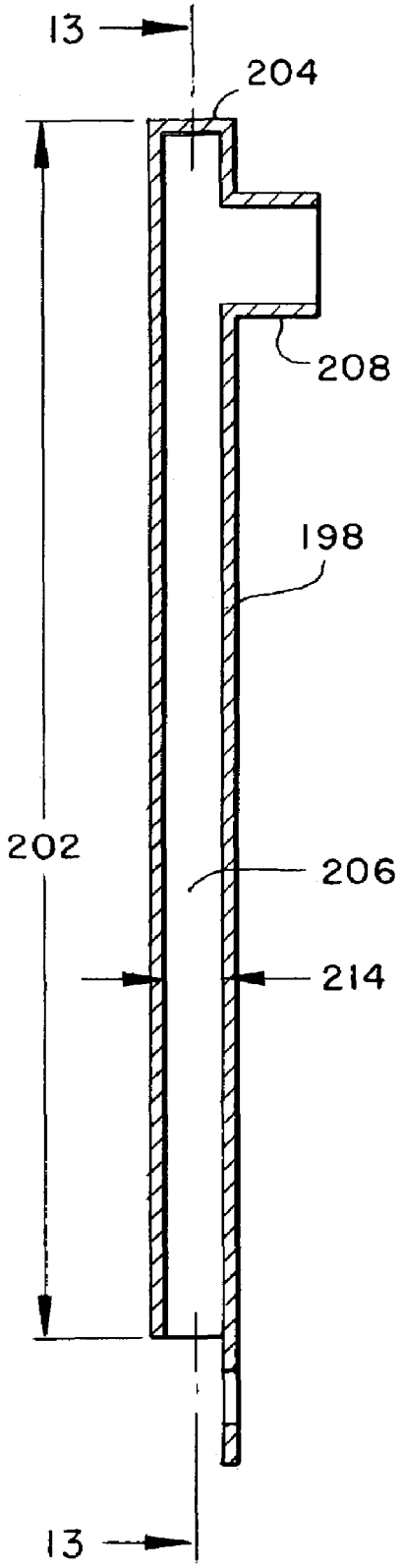
FIG. 12 is a cross-sectional view taken along line 12-12 of FIG. 13 and showing an oil drain tube.
Figure 13:
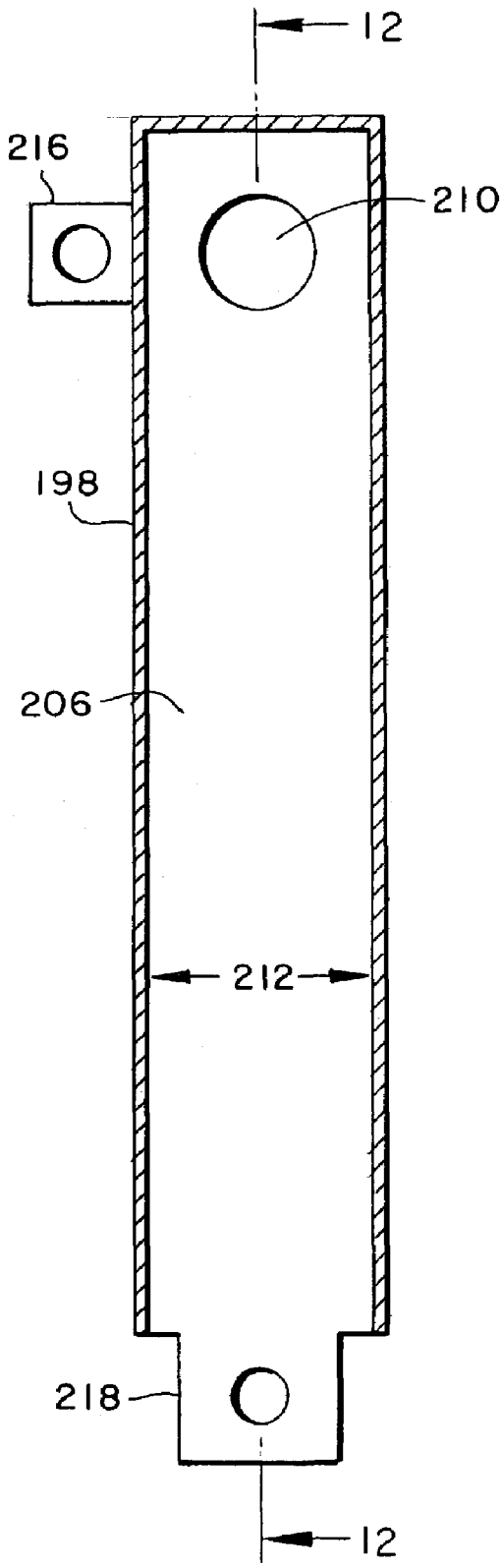
FIG. 13 is a cross-sectional view taken along line 13-13 of FIG. 12 .

Referring additionally now to FIGS. 12 and 13, drain tube 198 includes various features that enable it to effectively drain oil from cavity 196 while minimizing the oil's exposure to the flow of gas in suction pressure portion 139*b* of the compressor. Tube 198, for instance, has a length 202 that extends below lower apertures 148 of motor sleeve 134. An upper end 204 of tube 198 is capped, sealed or otherwise closed off. Tube 198 is also oblong (FIG. 11), which enables it to fit between compressor shell 138 and motor sleeve 134 while still providing an ample open area 206 for conveying oil. Area 206 is preferably equal to or larger than either the opening of oil passageway 200 or an opening in a short extension 208 that extends from tube 198.

In some cases, the inner diameter of oil passageway 200 is less than a maximum width 212 of area 206 and is greater than a minimum width 214. Mounting tabs 216 and 218 enable conventional threaded fasteners to attach tube 198 to the side of bearing housing 178 and/or motor sleeve 134. Tube 198 is preferably offset circumferentially relative to lower and upper apertures 146 and 148 of sleeve 134 so as not to obstruct gas flow through those apertures. Although tube 198 is shown circumferentially disposed 180 degrees away from suction inlet 166, the actual location of tube 198 may be at any position around motor sleeve 134. In some embodiments, tube 198 is positioned between 90 and 180 degrees from inlet 166.

The location of the oil return paths in relation to the gas flow pattern within compressor shell 138 can significantly affect how much oil the gas entrains in its flow through suction pressure portion 139*b* of shell 138 to the scroll members. Preferably, the gas exiting compressor 130 contains less than one percent by mass of entrained oil. To achieve this, gas 164 is directed through the compressor in a strategic manner.

Gas 164 enters compressor 130 through a suction inlet 166 that directs the flow toward a suction baffle 220. Referring additionally now to FIG. 14, baffle 220 includes a flow deflector plate 222 and a lower block-off 224 that cooperate to define a pocket 226 having an upper opening 228, such that baffle 220 deflects the incoming gas upward. As is best shown in FIG. 11, deflector plate 222 curves away from motor sleeve 134 and toward suction inlet 166 to enable suction baffle 220 to fit within the narrow, cylindrically shaped space between sleeve 134 and shell 138. The curved shape also provides rigidity to plate 222 and helps divert and spread the flow of gas circumferentially around sleeve 134 although the deflector's side edges 230 are adjacent to compressor shell 138 to ensure that the gas flow direction is directed generally upward as well.

Upon striking deflector plate 222, some of the entrained oil may separate from the incoming suction gas. The disentrained oil may drain out of pocket 226 through one or more liquid drain passageways defined in baffle 220, so the oil can return to sump 188. More importantly, the liquid drain passageways drain oil to the sump that might otherwise accumulate in pocket 226 at times when the compressor is inactive, particularly where the compressor is connected to a second running compressor via a manifold. In FIG. 14, the liquid drain passageways are holes 232 near the outside bottom corners of deflector plate 220. In the embodiment of FIG. 15, the liquid drain passageways of baffle 220*b* are provided by elongate channels 234 formed into plate 222*a*, whereby the oil can drain through channel 234 between plate 222*a* and shell 138. In another embodiment, shown FIG. 16, baffle 220*b* includes a flow deflector plate 222*b*, mounting edges 230*b*, and mounting tabs 233. In this case, slots 235 provide the liquid drain passageway. Also, deflector plate 222*b* is generally more planar for use in compressors having sufficient space between the motor sleeve and the outer shell.

Referring once again to FIGS. 10 and 11, after being deflected by suction baffle 220, the suction gas generally separates into two swirling flow streams which follow flow paths 236 and 238, with one being generally the mirror image of the other. The two gas flow paths 236 and 238 lie within suction chamber 136 of suction pressure portion 139*b* of compressor 130 and are generally on opposite sides of motor sleeve 134. Each flow path generally rises above upper apertures 146 and then descends below lower apertures 148. Flow path 236 travels partially around the circumference of motor sleeve 134 in a generally clockwise direction (about the rotor's rotational axis 185 as viewed from above in FIG. 14) and then reverses its rotation (again, about axis 185) near the bottom of flow path 236. Similarly, the other flow path 238 travels partially circumferentially around motor sleeve 134 in a generally counterclockwise direction (about the rotor's rotational axis 185 as viewed from above in FIG. 14) and then reverses its rotation (again, about axis 185) near the bottom of flow path 238.

The swirling flow patterns 236 and 238 are created by a number of the compressor's features that include, but are not limited to, the size, shape and location of apertures 146 and 148; the vertical spacing between apertures 146 and 148; the shape of suction chamber 136; the location of suction inlet 166 relative to apertures 146 and 148; and the geometry of suction baffle 220.

Substantially all of the gas 164 that enters suction pressure portion 139*b* of shell 138 passes through the combination of apertures 146 and 148 to move from suction chamber 136 to the interior of sleeve 134 where the gas flow cools motor 132 before entering the scroll wraps. A first portion of gas 164*a* travels sequentially through suction inlet 166, suction chamber 136, upper apertures 146, across motor upper end turns 240 (which helps cool the end turns). The gas then flows through one or more apertures 242 (FIGS. 9 and 10) of bearing housing 178, and to and between scroll wraps 152 and 154. From there the gas is compressed, is discharged into discharge pressure portion 139*a* of the compressor shell and exits the compressor through outlet 168 as gas stream 164*d*.

Suction inlet 166 is preferably disposed circumferentially between two of the upper apertures 146 in sleeve 134. The path of first portion of gas 164*a* causes less than all of the gas that enters suction pressure portion 139*b* of compressor 130 to circulate past sump 188. Thus, upper apertures 146 divert gas that might otherwise increase the gas flow velocity near sump 188. By lowering the gas velocity near sump 188, sump turbulence is reduced which, in turn, reduces the amount of oil that becomes entrained by the gas flow stream within the compressor.

A second portion of gas 164*b* travels sequentially through suction inlet 166, through suction chamber 136, through lower apertures 148, upward through gas passageways 140 and 142, across upper end turns 240, through aperture 242, and between scroll wraps 152 and 154. In some embodiments, gas passageways 140 and 142 are slots that run vertically along a stator core 244 of stator 144. Between the slots, the outer diameter of core 244 substantially abuts the inner surface of motor sleeve 134. The slots are preferably circumferentially offset relative to upper apertures 146.

A third portion of gas 164*c* travels sequentially through suction inlet 166, through lower aperture 148, downward between motor sleeve 134 and lower end turns 246, upward through rotor gap 172, and between the two scroll wraps 152 and 154.

In some embodiments, there are four upper apertures 146 that are each about 0.25-inches high by 1.25-inches wide, and there are eight lower apertures 148 that are each about 0.75-inches high by 1.5-inches wide. In other cases, the lower apertures are 1.5 inches by 1.5 inches. The lower apertures 148 are arranged in four pairs with each pair being generally centered beneath an upper aperture 146. This ensures that the first portion of gas 164*a* is less than a sum of the second portion of gas 164*b* plus the third portion of gas 164*c*. Also, the second portion of gas 164*b* is greater than the third portion of gas 164*c*.

To ensure well distributed cooling of end turns 240 and 246 occurs and to promote gas flow through apertures 146 and 148, upper apertures 146 are open to an area between upper end turns 240 and an upper edge of stator core 244, and lower apertures 148 are open to an area between lower end turns 246 and a lower edge of core 244.

Although the invention is described with respect to a preferred embodiment, modifications thereto will be apparent to those skilled in the art. For example, many of the features of compressor 130 can be applied to compressor 10 and vice versa. The features may pertain to various adaptable components including, but not limited to, suction line oil trap 74, suction baffle 220, oil drain tube 198, motor sleeve 134, bearing housings 52 and 178, diffuser 102, and counterweight 42. The scope of the invention, therefore, is to be determined by reference to the following claims:

The invention claimed is:

1. A scroll compressor for compressing a gas, wherein the scroll compressor is lubricated by a lubricant, the scroll compressor comprising:

a compressor shell defining a suction inlet;

a first scroll member disposed inside the compressor shell and having a first scroll wrap;

a second scroll member disposed inside the compressor shell and having a second scroll wrap interleaved with the first scroll wrap;

a stator for creating a magnetic field, the stator includes an upper end turns, a lower end turns, and a stator core interposed therebetween, the stator and compressor shell define therebetween a first gas passageway and a second gas passageway, wherein the first gas passageway conveys the gas in both upward and downward directions while the second gas passageway conveys the gas substantially only in an upward direction;

a rotor disposed within the stator to define a rotor gap therebetween, wherein the rotor rotates in response to the magnetic field and is coupled to the second scroll member to drive the second scroll member in an orbital motion relative to the first scroll member, thereby compressing the gas between the first scroll wrap and the second scroll wrap; and an oil trap that includes a suction tube leading to the suction inlet, an orifice plate extending radially inward from the suction tube for restricting gas flow therethrough, and a flow divider extending from the orifice plate in an upstream direction through the suction tube, wherein the orifice plate defines an opening through which substantially all of the gas and the lubricant within the suction tube eventually passes therethrough, wherein the location of the opening is biased toward a lower portion of the suction tube.

2. The scroll compressor of claim 1, wherein the suction tube includes an inner wall that is tapered at an angle greater than zero but less than twenty degrees as measured relative to a longitudinal centerline of the suction tube, such that the gas expands upon moving in a downstream direction through the suction tube.

3. The scroll compressor of claim 1, wherein the orifice plate has a crescent shape.

4. The scroll compressor of claim 1, wherein the flow divider has a semi-cylindrical shape.

5. The scroll compressor of claim 4, wherein the flow divider has two lower edges that are spaced apart from the suction tube.

6. A scroll compressor for compressing a gas, wherein the scroll compressor is lubricated by a lubricant, the scroll compressor comprising:

a compressor shell defining a suction inlet;

a first scroll member disposed inside the compressor shell and having a first scroll wrap;

a second scroll member disposed inside the compressor shell and having a second scroll wrap interleaved with the first scroll wrap;

a stator for creating a magnetic field, the stator includes an upper end turns, a lower end turns, and a stator core interposed therebetween, the stator and compressor shell define therebetween a first gas passageway and a second gas passageway, wherein the first gas passageway conveys the gas in both upward and downward directions while the second gas passageway conveys the gas substantially only in an upward direction;

a rotor disposed within the stator to define a rotor gap therebetween, wherein the rotor rotates in response to the magnetic field and is coupled to the second scroll member to drive the second scroll member in an orbital motion relative to the first scroll member, thereby compressing the gas between the first scroll wrap and the second scroll wrap; and a counterweight attached to the rotor, wherein the counterweight has a streamlined nose and a streamlined tail.

7. The scroll compressor of claim 6, wherein the streamlined nose comprises a beveled leading edge that lies at an angle relative to a rotational axis of the rotor.

8. The scroll compressor of claim 6, wherein the streamlined tail comprises a beveled trailing edge that lies at an angle relative to a rotational axis of the rotor.

9. The scroll compressor of claim 6, wherein the streamlined nose comprises a curved leading edge.

10. The scroll compressor of claim 6, wherein the streamlined tail comprises a curved trailing edge.

* * * * *